US010468818B2

(12) United States Patent
Giampi

(10) Patent No.: US 10,468,818 B2
(45) Date of Patent: Nov. 5, 2019

(54) MAGNETICALLY ACTIVATED POWER SOCKET AND PLUG COMBINATION

(71) Applicant: Philip Giampi, Huntington Beach, CA (US)

(72) Inventor: Philip Giampi, Huntington Beach, CA (US)

( * ) Notice: Subject to any disclaimer, the term of this patent is extended or adjusted under 35 U.S.C. 154(b) by 0 days.

(21) Appl. No.: 16/235,033

(22) Filed: Dec. 28, 2018

(65) Prior Publication Data

US 2019/0140393 A1 May 9, 2019

Related U.S. Application Data

(63) Continuation-in-part of application No. 15/875,852, filed on Jan. 19, 2018, now Pat. No. 10,312,640.

(60) Provisional application No. 62/448,878, filed on Jan. 20, 2017.

(51) Int. Cl.

| | |
|---|---|
| ***H01R 13/62*** | (2006.01) |
| ***H01R 13/629*** | (2006.01) |
| ***H01R 13/703*** | (2006.01) |
| *H01R 24/38* | (2011.01) |
| *H01R 103/00* | (2006.01) |
| *H01R 105/00* | (2006.01) |

(52) U.S. Cl.

CPC ..... *H01R 13/6205* (2013.01); *H01R 13/629* (2013.01); *H01R 13/7037* (2013.01); *H01R 24/38* (2013.01); *H01R 2103/00* (2013.01); *H01R 2105/00* (2013.01)

(58) Field of Classification Search

CPC ..... H01R 13/6205; H01R 11/30
USPC ..... 439/39
See application file for complete search history.

(56) References Cited

U.S. PATENT DOCUMENTS

| | | | | |
|---|---|---|---|---|
| 3,521,216 A * | 7/1970 | Tolegian | ..... | H01R 13/6205 439/152 |
| 3,808,577 A * | 4/1974 | Mathauser | ..... | H01R 13/6205 439/39 |
| 3,810,258 A * | 5/1974 | Mathauser | ..... | H01R 13/6205 439/39 |
| 6,623,276 B2 * | 9/2003 | Dalmau Ferrerfabrega | ..... | H01R 13/6205 335/205 |
| 7,967,609 B2 * | 6/2011 | Capece | ..... | H01R 31/06 439/39 |
| 8,105,091 B2 * | 1/2012 | Nishihira | ..... | H01R 13/6205 439/39 |

(Continued)

*Primary Examiner* — Tulsidas C Patel
*Assistant Examiner* — Peter G Leigh
(74) *Attorney, Agent, or Firm* — Marcus C. Dawes

(57) ABSTRACT

The system includes a magnetically actuated electrical power socket and a magnetic plug. The plug includes an insulating cylindrical plug body, a plurality of conductive ring contacts provided on the face of the cylindrical plug body, a permanent magnet disposed in the center of the plug body. The magnetically actuated electrical power socket includes an insulating fixed face, a corresponding plurality of fixed conductive contacts in the face, a movable cam lever disposed behind the face, a corresponding plurality of insulatively isolated transfer contacts disposed on a corresponding plurality of spring arms, which spring arms normally maintain the cam lever from the face, and a corresponding plurality of fixed conductive terminals extending from the rear of the socket module electrically coupled to the transfer contacts.

20 Claims, 8 Drawing Sheets

(56) References Cited

U.S. PATENT DOCUMENTS

| | | | | |
|---|---|---|---|---|
| 8,602,795 | B2 * | 12/2013 | Hsu | H01R 13/6205 439/39 |
| 9,004,930 | B2 * | 4/2015 | Gualino | H01R 13/2421 439/136 |
| 9,083,110 | B2 * | 7/2015 | McClelland | H01R 13/6205 |
| 9,088,097 | B2 * | 7/2015 | Kim | H01R 13/6205 |
| 9,225,125 | B2 * | 12/2015 | Iwamoto | H01R 13/70 |
| 9,281,638 | B2 * | 3/2016 | McBroom | H01R 24/38 |
| 10,125,921 | B2 * | 11/2018 | Khodapanah | F16M 13/02 |
| 10,135,179 | B2 * | 11/2018 | Cooper | A47J 37/0611 |
| 2002/0160629 | A1 * | 10/2002 | Lau | H01R 13/4534 439/39 |
| 2011/0059623 | A1 * | 3/2011 | Capece | H01R 13/7037 439/39 |
| 2015/0093919 | A1 * | 4/2015 | McBroom | H01R 24/38 439/39 |
| 2015/0318638 | A1 * | 11/2015 | McClelland | H01R 13/629 439/105 |
| 2015/0364862 | A1 * | 12/2015 | Lin | H01R 13/6205 439/39 |
| 2016/0149339 | A1 * | 5/2016 | Kim | H01R 13/6205 439/40 |
| 2016/0301172 | A1 * | 10/2016 | Liu | H01R 24/38 |

* cited by examiner

MAGNETICALLY ACTIVATED POWER SOCKET AND PLUG COMBINATION

BACKGROUND

Field of the Technology

The invention relates to the field of electrical power connectors without axially extending prongs or probes and which connectors are activated by a magnetic force. CPC H01R13/7037

Description of the Prior Art

Conventional power connectors comprise of a male plug component having contact prongs extending axially or longitudinally outwards for insertion into a corresponding receiving member in a female plug component or a socket, where the receiving member mechanically holds the prongs in place and the male and female plug components are electrically connected using frictional force. The susceptibility of conventional designs to tampering by children or inadvertent contact with the conducting prongs is legend with an estimated number of instances of at least 2400 children each year being severely shocked or burned with a dozen fatalities by insertion of metallic objects into the sockets or inadvertent touching of the prongs.

Some prior art designs employ shutters in the socket which only allow two prongs to be simultaneously inserted. However, these designs are often difficult to manipulate and still do not render the socket tamperproof.

A number of designs have been proposed to lessen the chance of electrocution by tampering some of which employ a magnet to activate the electrical contacts and to couple the plug to the socket, such as shown in US Patent Application 2016/0336695. However, such designs incorporate magnetically actuated power switching circuits, which increase the cost of the design and its long-term reliability and robustness.

In addition to the problem of tamper proofing a power plug and socket, there are general disadvantages to conventional prong and socket systems. In most instances two-prong plugs are unidirectional with one prong being wider than the other. For such plugs it sometimes hard to tell which way the plug needs to be oriented to plug in. This invites inadvertent contact with the prongs.

A three-prong plugs is sometimes hard to plug in because all three prongs must simultaneously engage the corresponding sockets. It is common in a three-prong plug to break the grounding prong. Often users actually break the grounding prong off intentionally to accommodate a nonconforming outlet or extension cord.

Bent prongs need to be straightened out in order to be successfully used, again inviting unintended contact with a live prong. Pulling on a connected power cord, such as by a vacuum, can bend the prongs, and possibly break the outlet.

It is not uncommon for a socket to lose its resilient fit over time such that the plug is too loose, falls out or causes arcing.

New receptacles on the other hand can be hard to plug in or to unplug, if the clearances are small and the socket is tight. If a socket is not mounted correctly, it can be pushed into the wall or junction box resulting in possibility of malfunction. Pulling a plug by its wire can break the connection to the plug on the inside causing it to malfunction, or even rip out the cord from the plug. Pulling it sideways, bends the prongs or could break the outlet.

Users often find it hard to plug in a cord into a socket located behind an object or piece of furniture, thus leading the user to try to feel the prongs and inviting inadvertent contact with a live prong.

What is needed is a design for an electrical socket and plug that avoids each of the disadvantages of the prior art.

BRIEF SUMMARY

The illustrated embodiments of the invention include a magnetically actuated electrical power socket and plug system. The plug includes a plurality of conductive ring contacts provided on the face of an insulating cylindrical plug body. In the center of the plug body is a permanent magnet around which the ring contacts are disposed. In the illustrated embodiment a three wire plug is described, but any number of wires could be accommodated within the design.

A socket module is provided which has an insulating fixed face in which there are a corresponding plurality of fixed conductive contacts in the face. The face contacts are normally inactive or without electrical power. Behind the fixed face and spaced therefrom is a movable ferromagnetic transfer bar carrying a corresponding plurality of insulatively isolated transfer contacts aligned with the face contacts. The transfer bar is carried or positioned within the socket module by a plurality of extension springs, which normally maintain the transfer bar spaced apart from the face.

The transfer contracts are wired or electrically coupled to a corresponding plurality of fixed conductive terminals extending from the rear of the socket module. The fixed terminals are conventionally coupled or can be wired to conventional three wire house wiring or conventional electrical power circuits.

When the magnetic plug is disposed into the a receiving socket well on the face, the magnet in the plug attracts the ferromagnetic bar forward against the force of the extension springs bringing the transfer contacts on the transfer bar into electrical continuity with the rear surface of the contacts mounted in the face. Electrical continuity is therefore established from the ring contacts in the plug to the face contacts, the transfer bar contacts, to the terminals and thence to the power circuit. The ring contacts are wired through the plug to a conventional three wire cord and thence made available for general electrical power utilization. When the magnetic plug is removed from the socket well, the springs retract the transfer bar from the face and electrical continuity with the face contacts is interrupted. The face contacts are then not electrified and can be safely be touched without the possibility of electrical shock hazard.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
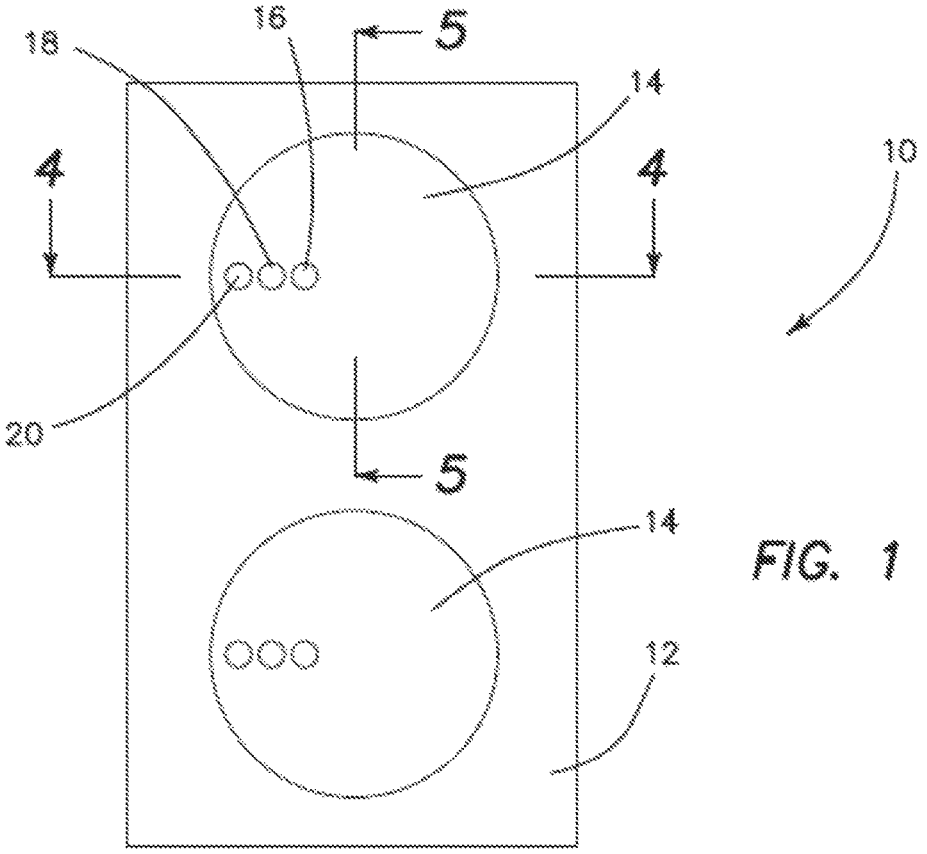
FIG. 1 is a plan diagrammatic view of a wall socket of a first embodiment of the invention.

FIG. 1 is a plan view of a wall socket module 10 of a first embodiment of the invention. In the illustrated embodiment wall socket module 10 includes a wall bar 12 with two sockets 14 which are shallow circular recesses defined into the thickness of wall bar 12. Sockets 14 are preferentially circular in shape in order to allow for total azimuthal symmetry. In other words, as will be made clear below, it will make difference at what azimuthal angle or orientation that plug 26 is set or disposed into socket 14. All and any azimuthal orientation will be equivalent and operable. However, if in any application it would to be to an advantage to require socket 14 to have a preferred azimuthal orientation for operation, it is within the scope of the invention that other shapes for socket 14 could be substituted.

Wall bar 12 is made of plastic or other nonconducting material and can be attached to the electrical junction box (not shown) by any means or method conventionally employed. Typically, wall bar 12 will be fixed to the junction box using two machine screws disposed through opposing top and bottom mounting holes 22. Alternatively a center mounting hole may be provided (not shown). Defined into the bottom surface of each recess of socket 14 are a plurality of selectively activatable electrical contacts 16, 18 and 20. As will be described in greater detail in FIG. 8, electrical contacts 16, 18 and 20 are flush or nearly flush with the bottom surface of the recessed socket 14. In the illustrated embodiment, three electrical contacts 16, 18 and 20 are provided, but the spirit and scope of the invention contemplates the use of any number of contacts as may be needed in any specific application.

Figure 2:
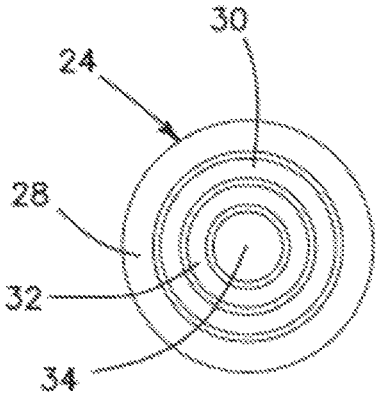
FIG. 2 is a front plan diagrammatic view of a plug matching the socket of FIG. 1.

FIG. 2 is an anterior plan view of the face 24 of a plug 26 matching the socket 14 of FIG. 1. In the illustrated embodiment, three electrical contacts 28, 30, and 32 are provided on face 24 of plug 26, but again the spirit and scope of the invention contembars the use of any number of contacts as may be needed in any specific application. The body of plug 26 is made of plastic or other nonconducting material. Face 24 is circular in cross section and electrical contacts 28, 30, and 32 are defined as ring contacts centered on the circular face 24 and are flush or nearly flush with face 24. The innermost contact 32 is designated as the hot electrode, the middle contact 30 is the neutral electrode and the outermost contact 28 is the ground electrode in a three-wire electrical plug 26. It is to be understand that all other orderings of the designation of the contacts 28, 30, and 32 are also contemplated as within the scope of the invention. Therefore, in the illustrated embodiment contact 16 of socket 14 in FIG. 1 is designated as the ground electrode, contact 18 as the neutral electrode and contact 20 as the hot electrode. A permanent magnet 34 is disposed and fixed in the body of plug 26 in the center of face 24 and is circumscribed by contact 28. It is within the scope of the invention that the magnet would be differently positioned or configured. For example, an outer ring magnet could be employed or multiple magnets located at different positions of face 24 if desired.

Figure 3:
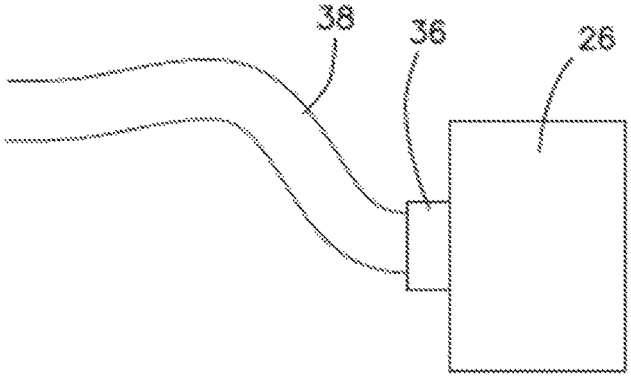
FIG. 3 is a side elevational diagrammatic view of the plug of FIG. 2 and its connecting wire.

FIG. 3 is a side elevational view of the plug 26 of FIG. 2 and its connecting wire 38 with a stress relief ferrule 36. Plug 26 is shown as a right prismatic cylinder, but it is within the scope of the invention that only the portion of plug 26 near face 24 need be a circular cylindrical section and the shape of the remainder of the body of plug 26 can be freely chosen.

Figure 4:
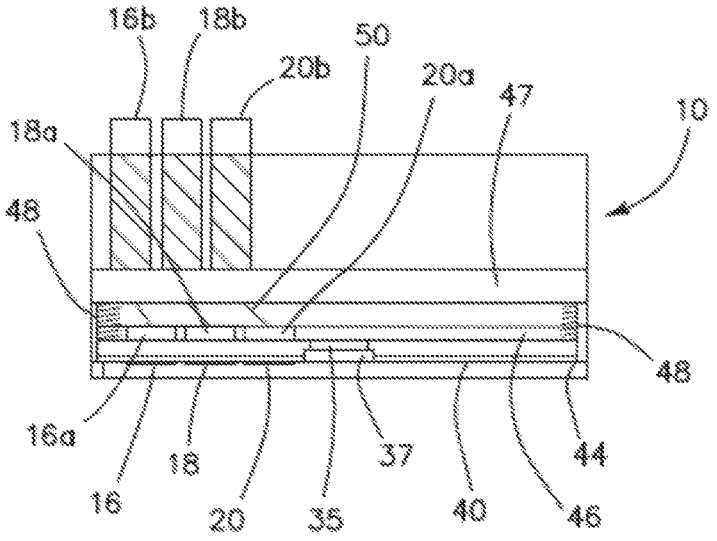
FIG. 4 is a top cut away diagrammatic view of the socket of FIG. 1 as seen through the plane of line 4-4 of FIG. 1 when the magnetic plug is removed from the socket or otherwise not present.

FIG. 4 is a top cut away view of the socket 14 of FIG. 1 as seen through the plane of line 4-4 of FIG. 1 when the magnetic plug 26 is removed from the socket 14 or otherwise not present or inoperative. Contacts 16, 18, and 20 are disposed in a fixed nonconducting bar 40 comprising the front surface of a socket module 10. A circumferential circular lip 44 circumscribes bar 40 and provides a mechanical guide into which plug 26 is easily mated or disposed in order to center plug 26 with respect to socket 14.

Figure 6:
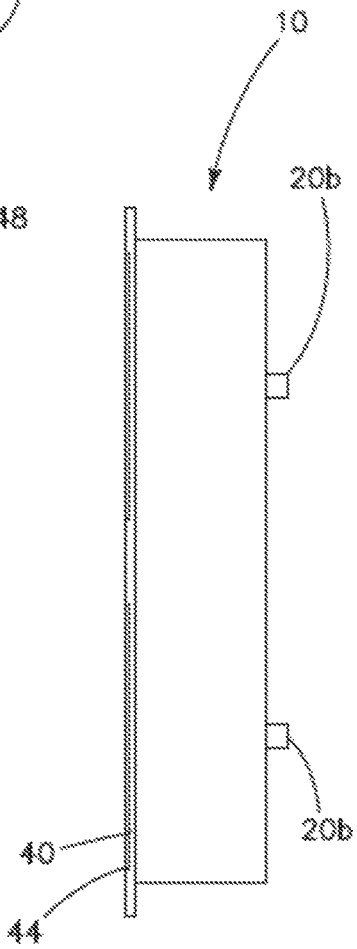
FIG. 6 is a side elevational diagrammatic view of the socket of FIG. 1.
Figure 10A:
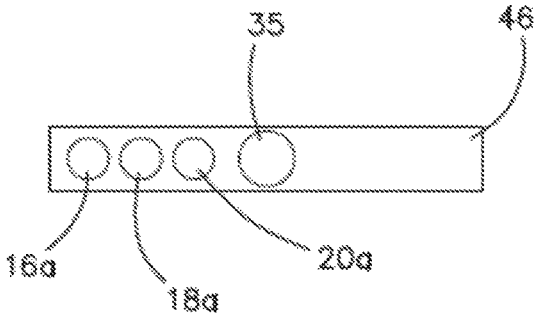
FIG. 10*a* is a front plan view of movable slide carrying the transfer contacts.
Figure 10B:
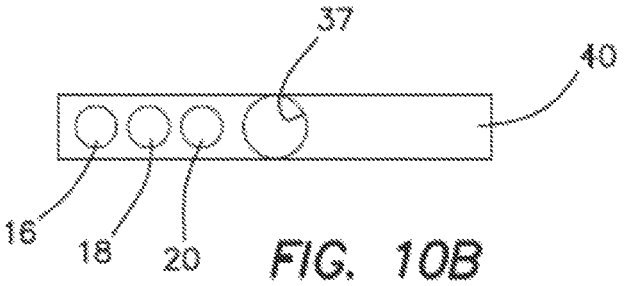
FIG. 10*b* is a front plan view of a fixed bar carrying the electrical contacts of FIG. 8 on the front face of the socket.

Spaced behind contact bar 40 is a movable ferromagnetic or magnetic transfer slide 46. Slide 46 is shown in plan view in FIG. 10A as carrying transfer contacts 16*a*, 18*a* and 20*a* and a magnet 35. Contact bar 40 is shown in plan view in FIG. 10B as including face contacts 16, 18 and 20 along with a hole 37 defined through bar 40 through which aligned magnet 35 fixed to slide 46 may be disposed. Transfer contacts 16*a*, 18*a* and 20*a* are disposed or fixed into transfer slide 46, but electrically insulated therefrom so that they are not shorted out with each other. Transfer contacts 16*a*, 18*a* and 20*a* are aligned with fixed contacts 16, 18 and 20 respectively in fixed bar 40, such that when transfer slide 46 is moved forward as described below, transfer contacts 16*a*, 18*a* and 20*a* achieve electrical continuity with contacts 16, 18 and 20 respectively. Transfer slide 46 is mounted on a plurality of extension springs 48 extending between contact bar 40 and transfer slide 46 in a plurality of end positions of bars 40 and 46. Each of the transfer contacts 16*a*, 18*a* and 20*a* is electrically coupled by means of a flexible wire or resilient conducting lead 50 to corresponding fixed terminals 16*b*, 18*b* and 20*b* respectively. Terminals 16*b*, 18*b* and 20*b* are thus the ground, neutral and hot terminals respectively of socket module 10, are fixed to mounting bar 47 and extend to the rear of socket module 10 to allow for conventional coupling to the house or power electrical wiring. FIG. 6 is a side elevational view of the socket module 10 of FIG. 1 showing two rows of terminals in module 10 with only terminal 20*b* seen.

Figure 5:
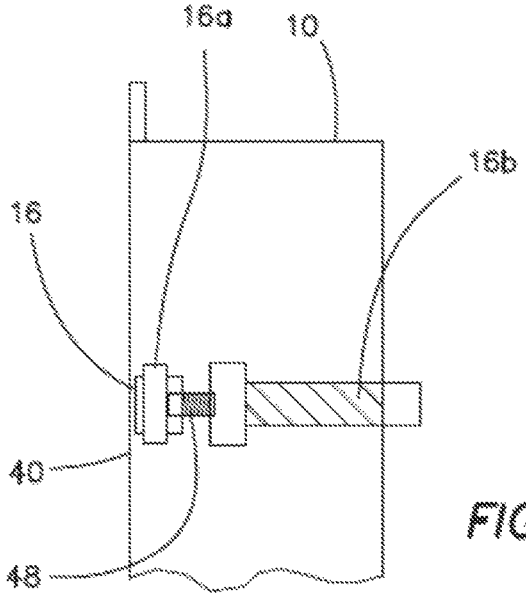
FIG. 5 is a side cut away diagrammatic view of the socket of FIG. 1 as seen through line 5-5 of FIG. 1.
Figure 7:
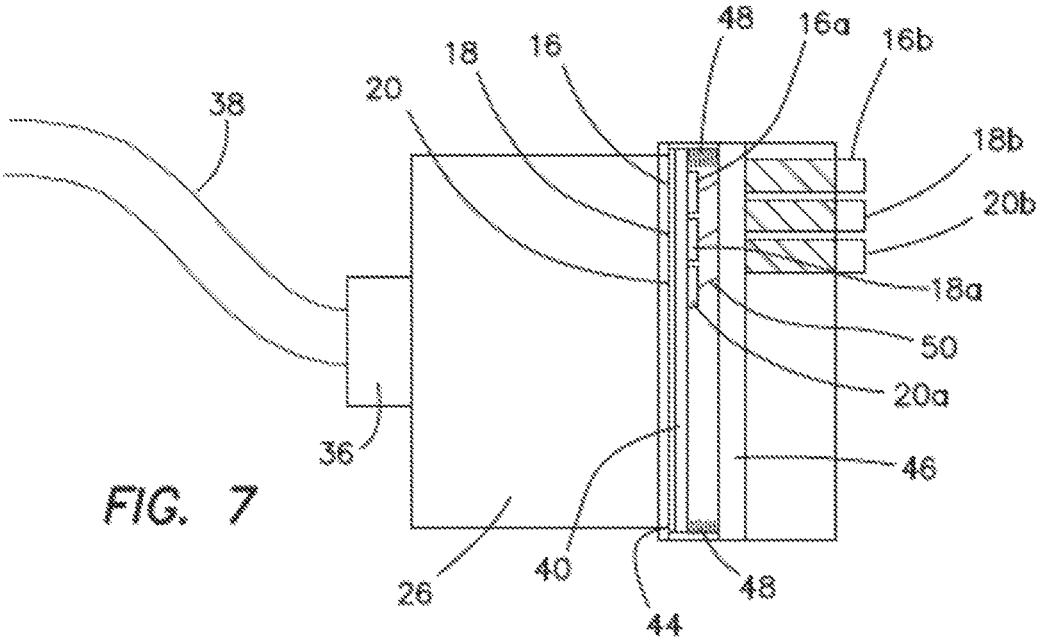
FIG. 7 the a top cut away diagrammatic view of the socket of FIG. 1 as seen through the plane of line 4-4 of FIG. 1 when the magnetic plug is present and the contacts are activated.

The operation of socket module 10 may now be understood. Socket module 10 is normally in an inactivated configuration as shown in FIG. 4. However, when magnetic plug 26 is disposed into socket 14, the magnet 34 in plug 26 will attract ferromagnetic or magnetic transfer slide 46 toward bar 40 against the tensile force of extension springs 48 by reason of either the ferromagnetic quality of slide 46 or the mutual attraction of magnets 34 and 35 or both. Contacts 16*a*, 18*a* and 20*a* will come into electrical contact with contacts 16, 18 and 20 respectively and electrical continuity will be established from contacts 16, 18 and 20 through contacts 16*a*, 18*a* and 20*a* through wires 50 to terminals 16*b*, 18*b* and 20*b* respectively. The spring constants of extension springs 48, the degree of their extension, and the spacing of bars 40 and 46 are selected so that force of magnet 34 is always sufficient to securely move slide 46 toward bar 40 to establish electrical continuity between contacts 16, 18 and 20 and contacts 16*a*, 18*a* and 20*a* respectively. Socket module 10 is now in the activated configuration shown in to the top cut-away view of FIG. 7 or in the cut away view of FIG. 5 as seen through line 5-5 of FIG. 1. FIG. 7 the a top cut away view of the socket module 10 of FIG. 1 as seen through the plane of line 4-4 of FIG. 1 when the magnetic plug 26 is present and the contacts 16, 18 and 20 are activated. In the activated configuration electrical power is or can be supplied to plug 26.

In the illustrated embodiment, transfer slide 46 is spaced from the walls of socket module 10 and free floating on springs 48 so that there is no mechanical friction resisting the movement of slide 46 either toward or away from bar 40. When magnetic plug 26 is removed from socket 14, the magnetic force holding slide 46 forward against bar 40 is lessened or removed and springs 48 retract slide 46 to place socket module 10 into the inactivated configuration. However, if more mechanical stability is required, it is within the scope of the invention that keys and keyways can be defined (not shown) in the interior walls of socket module 10 and/or slide 46 to guide slide 46 in its forward and backward movements within socket module 10.

It is also within the scope of the invention that if less magnetic force is able to satisfactorily operate socket module 10 that magnet 35 may be omitted. Although it is not the preferred embodiment, plug 26 may be ferromagnetic instead of carrying magnet 34 and attraction between plug 26 and slide 46 will be provided by the interaction of magnet 35 in slide 46 with the ferromagnetic quality of plug 26.

Figure 8:
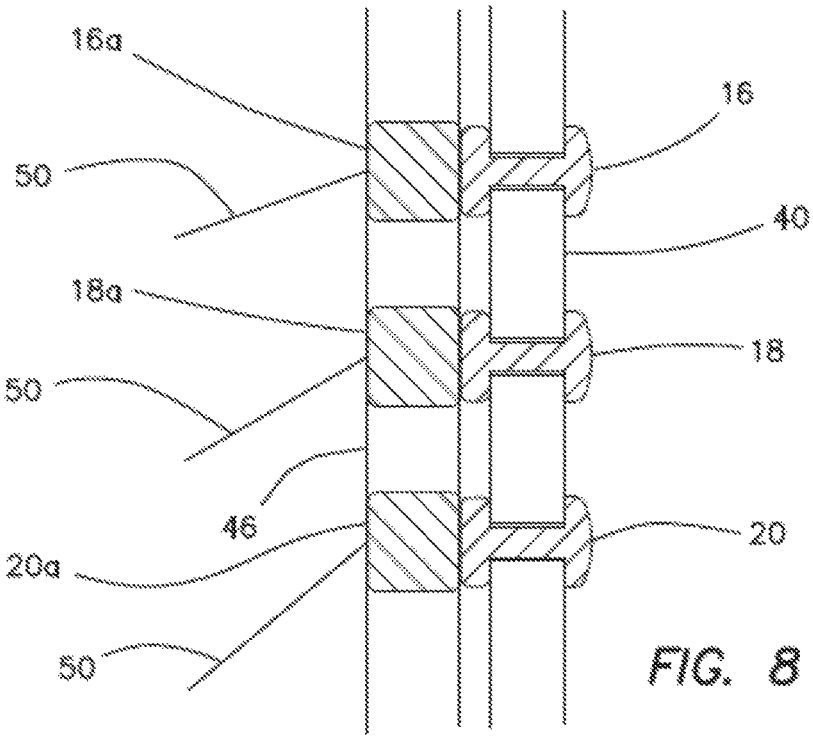
FIG. 8 is a close-up top cross sectional diagrammatic view of the face contacts and the activated transfer contacts when engaged with the face contacts.

FIG. 8 is a close-up top cross sectional fragmentary view of the face contacts 16, 18, and 20 and the activated transfer contacts 16*a*, 18*a*, and 20*a* when engaged with the face contacts 16, 18, and 20 respectively. Contacts 16, 18, and 20 are shown in exaggerated form as dumbbell shaped with enlarged heads or contact surfaces extending from the front and rear surface of bar 40. In the illustrated embodiment contacts 16, 18 and 20 are loosely retained by their dumbbell shape in bar 40 to allow a limited degree of movement or angular orientability of contacts 16, 18 and 20 in bar 40. This allows contacts 16, 18 and 20 to settle in an optimal or conforming position or orientation between the ring contacts 28, 30 and 32 of plug 26 and transfer contacts 16*a*, 18*a* and 20*a* of socket module 10 in any given connection or mating notwithstanding small misalignments in any of the components.

Figure 9:
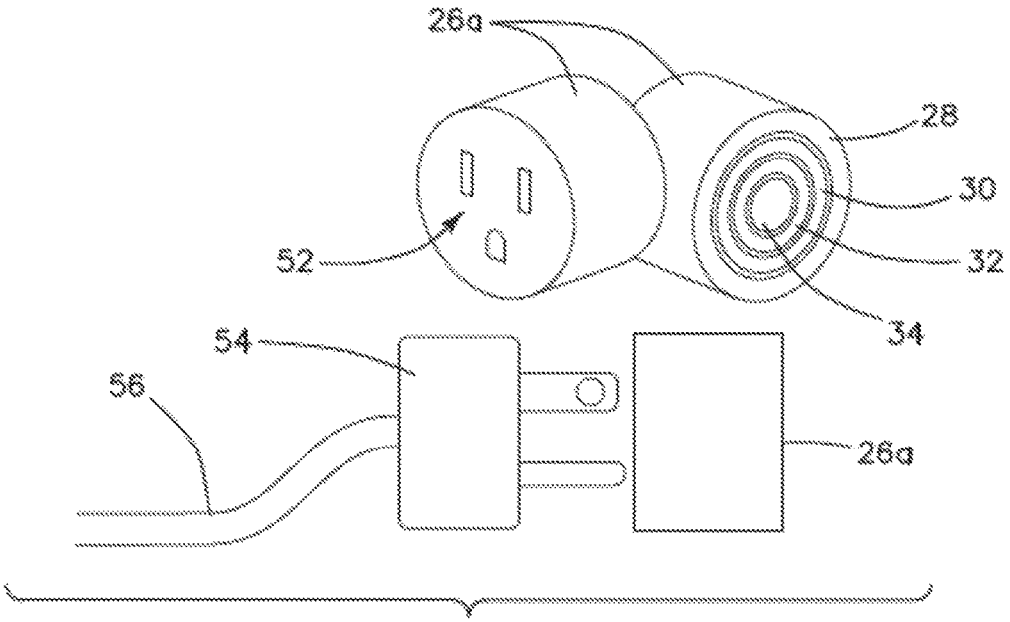
FIG. 9 is a perspective diagrammatic view of an adapter used with the embodiment of FIGS. 1-8 when employed with a conventional plug.

FIG. 9 is a perspective view of an adapter 26*a* used with the embodiment of FIGS. 1-8 when employed with a three-prong conventional plug 54. Magnetic plug 26 and socket module 10 comprises an integral or compatible electrical mating system. However, as with the introduction of any new technology means must be provided to allow for compatibility or use with pre-existing conventional systems. Adapter 26*a* has the identical material components of plug 26 of FIGS. 2 and 3, namely ring contacts 28, 30, and 32 and magnet 34 insulatively separated from each other provided on one end of adapter 26*a*, but these contacts 28, 30, and 32 are internally coupled or wired (not shown) to a conventional three-pronged socket 52 provided on the opposing end of adapter 26*a*. As shown in the lower portion of FIG. 9, adapter 26*a* is connectable to a conventional three-pronged plug 54 and cord 56. Adapter 26*a* can then be disposed into socket module 10 to allow operation according to the illustrated embodiment of the invention.

In the foregoing a circular shape has been shown for contacts 16, 18, 20, 16*a*, 18*a*, and 20*a*, however it is within the scope of the invention that contacts 16, 18, 20, 16*a*, 18*a*, and 20*a* may assume any cross sectional shape or size and need not be equal to each other. For example contacts 16, 18 and 20 may be circular in cross-sectional shape with a first diameter and transfer contacts 16*a*, 18*a* and 20*a* may have a circular cross-sectional shape with a second different or large diameter, or may assume a different cross-sectional shape if desired.

Turning to FIGS. 11-19B, an alternative embodiment of the wall socket module 100 may be seen. In this particular embodiment, the wall socket module 100 comprises a cam system 102 which is used to bring the transfer contacts 16*a*, 18*a*, and 20*a* into surface contact with the face contacts 16, 18, 20 disposed within the sockets 14 of the wall bar 12 when the magnetic plug 26 is present. As seen in the side view of FIG. 11, the cam system 102 comprises a cam lever 104 which is disposed within a cam-shaped body 106. The cam-shaped body 106 is in turn rotatably coupled to an insulation layer 110 through a pivot point 108. The cam lever 104 is preferably comprised of metal, in particular steel, while the cam-shaped body 106 is preferably comprised of an insulating material such as plastic. As seen in the exploded view of FIG. 12, the cam-shaped body 106 comprises a substantially similar shape as the lower portion of the cam lever 104 so as to prevent the cam lever 104 from making unwanted contact with the insulation layer 110.

Figure 11:
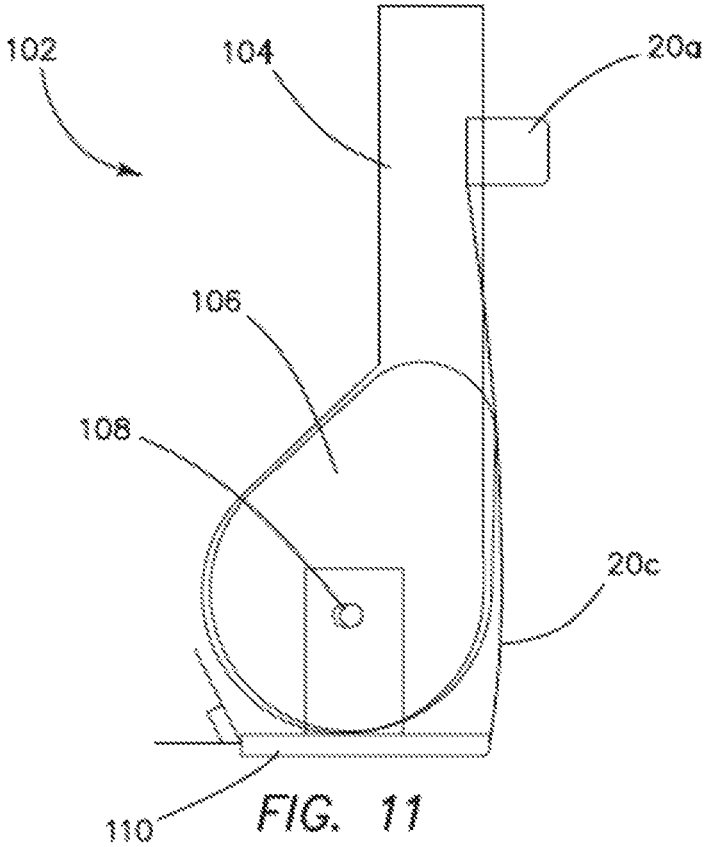
FIG. 11 is a magnified side view of an alternative embodiment of the internal components of the socket module comprising a cam system.
Figure 12:
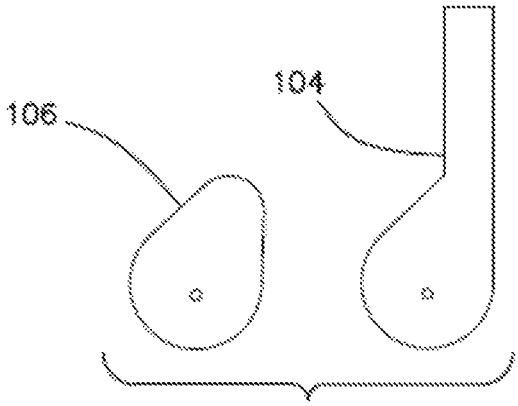
FIG. 12 is a partially exploded view of the cam system showing the cam lever and the cam-shaped body.
Figure 13:
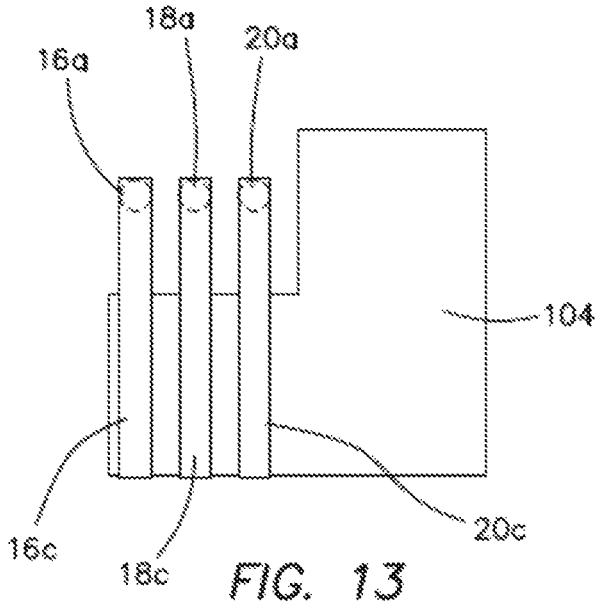
FIG. 13 is a magnified view of the distal end of the cam lever and how the cam lever is configured relative to the plurality of spring arms and transfer contacts.
Figure 14A:
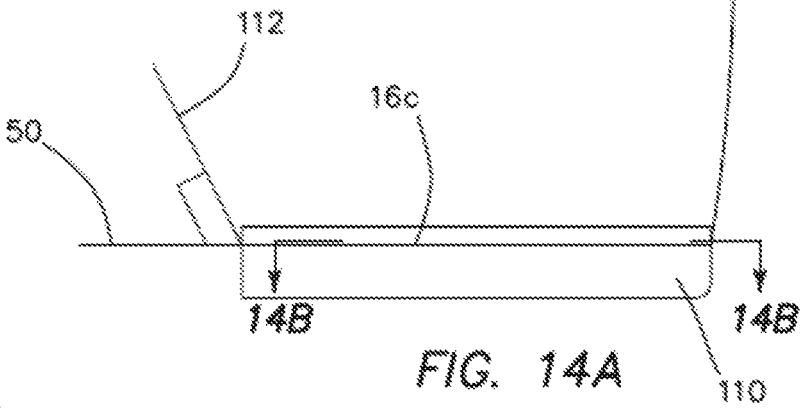
FIG. 14A is a side elevational view of a portion of the cam system, specifically how the spring arms are disposed within the insulation layer.
Figure 14B:
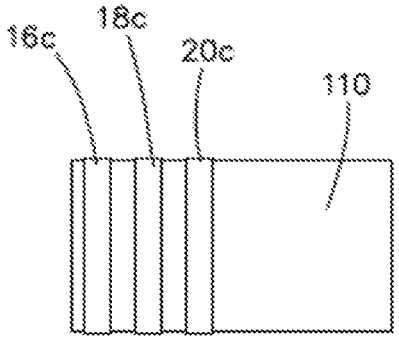
FIG. 14B is a top down cross sectional view of the spring arms and insulation layer seen in FIG. 14A.

Turning to FIGS. 14A and 14B, the insulation layer 110 comprises a plurality of conductive spring arms 16*c*, 18*c*, 20*c* disposed through the middle of the insulation layer 110. The spring arms 16*c*, 18*c*, 20*c* further extend from a lateral edge of the insulation layer 110 and are bent or curved upwards relative to the insulation layer 110. At the distal ends of each of the spring arms 16*c*, 18*c*, 20*c* is a corresponding transfer contact 16*a*, 18*a*, 20*a*. The distal end of the cam lever 104 is shaped to actively cooperate with the spring arms 16*c*, 18*c*, 20*c* as seen in FIG. 13 in order to ensure proper contact between the cam lever 104 and the spring arms 16*c*, 18*c*, 20*c* when a plug 26 is present as is detailed further below. FIG. 14A is a side elevational view of the insulation layer 110 of FIG. 11 where only spring arm 16*c* and its corresponding transfer contact 16*a* may be seen. FIG. 14B in turn is a top cut away view of the insulation layer 110 as seen through the plane of line 14B-14B of FIG. 11 showing the placement of the plurality of spring arms 16*c*, 18*c*, 20*c* disposed there through.

Figure 15:
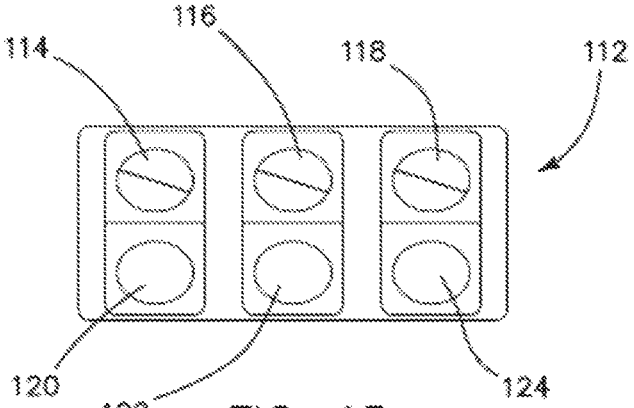
FIG. 15 is magnified frontal view of the screw terminal portion of the cam system seen in FIG. 11.

At their respective proximal ends, each of the spring arms 16*c*, 18*c*, 20*c* are coupled to a screw terminal 112 which, as best seen in FIG. 15, comprises a hot terminal 114, a neutral terminal 116, and a ground terminal 118. In one particular embodiment, spring arm 16*c* comprising transfer contact 16*a* is coupled to ground terminal 118, while spring arm 18*c* comprising transfer contact 18*a* is coupled to neutral terminal 116, and spring arm 20*c* comprising transfer contact 20*a* is coupled to hot terminal 114. The screw terminal 112 further comprises a plurality of wire inserts, namely a hot wire insert 120 which is electrically coupled to the hot terminal 114, a neutral wire insert 122 which is electrically coupled to the neutral terminal 116, and a ground wire insert 124 which is electrically coupled to the ground terminal 118. When a flexible wire or resilient conducting lead 50 is coupled to corresponding wire terminals 120, 122, and 124, transfer contacts 16*a*, 18*a*, and 20*a* are thus the ground, neutral, and hot contacts, respectively, of socket module 100. The flexible wires 50 extend to the rear of socket module 100 to allow for conventional coupling to the house or other power electrical wiring.

Figure 16:
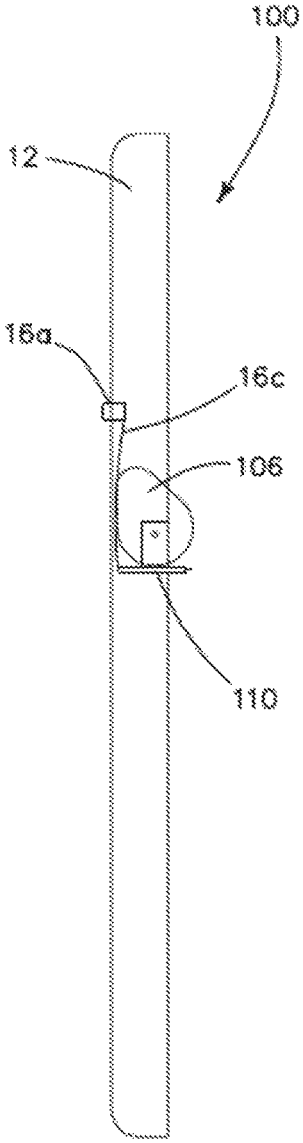
FIG. 16 is a cross sectional side view of the alternative embodiment of the socket module comprising the cam system seen in FIG. 11.

FIG. 16 shows the placement of cam system 102 in relation to the alternative socket module 100. Specifically, the cam system 102 including the insulation layer 110, spring arms 16*c*, 18*c*, 20*c*, and the transfer contacts 16*a*, 18*a*, 20*a* are all disposed behind the wall bar 12. Only one of the plurality of spring arms 16*c* and only one of the transfer 16*a* contacts may be seen in FIG. 16, however it is to be understood that this if for clarity purposes only and that each of the plurality of spring arms and transfer contacts are disposed behind the wall bar 12. Additionally, the cam lever 104 is not seen in FIG. 16 so as to provide further clarity with regard to the placement of the spring arms in relation to the wall bar 12.

Figure 17A:
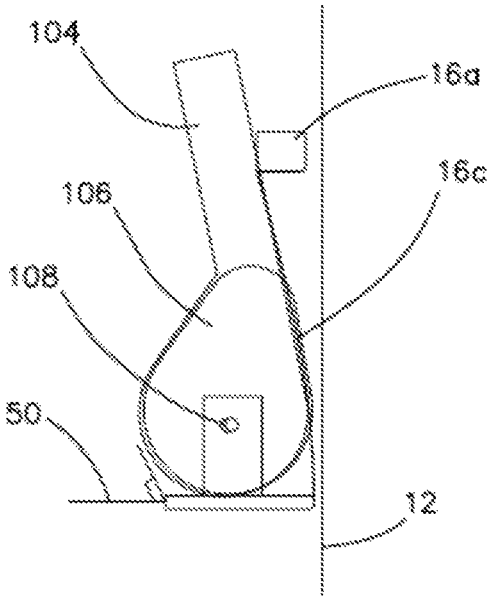
FIG. 17A is a magnified cross sectional view of the alternative embodiment of the socket module when the cam lever is in the inactive position.
Figure 17B:
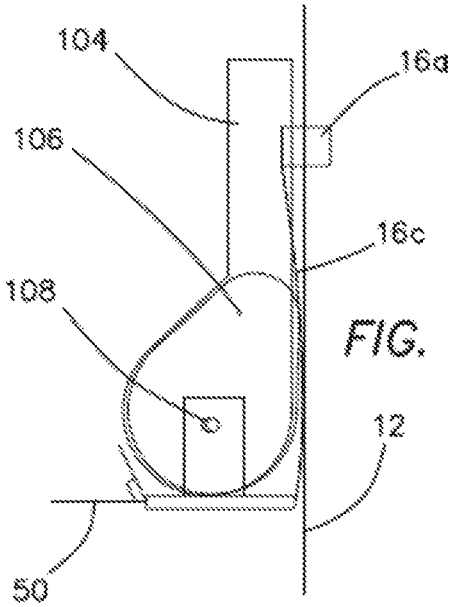
FIG. 17B is a magnified cross sectional view of the alternative embodiment of the socket module when the cam lever is in the active position.

The operation of socket module 100 may now be understood by turning to FIGS. 17A and 17B. Socket module 100 is normally in an inactivated configuration as shown in FIG. 17A. However, when magnetic plug 26 is disposed into socket 14, the magnet 34 in plug 26 will attract the metal cam lever 104 toward the wall bar 12 against the spring force of the spring arms 16*c*, 18*c*, 20*c* by rotating about pivot point 108. Specifically, as the cam lever 104 rotates under the magnetic force of the magnet 34, the cam lever 104 makes contact with the plurality of spring arms 16*c*, 18*c*, 20*c* and pushes them forward toward the wall bar 12. The cam lever 104 continues to rotate until the transfer contacts 16*a*, 18*a*, 20*a* disposed on the distal ends of the spring arms 16*c*, 18*c*, 20*c* come into electrical contact with corresponding face contacts 16, 18, 20 in a similar manner as detailed above with regard to the prior embodiment. When the cam lever 104 is fully actuated as seen in FIG. 17B, electrical continuity is established from the face contacts 16, 18, 20 through the transfer contacts 16*a*, 18*a*, 20*a* and then through spring arms 16*c*, 18*c*, 20*c* and finally to terminals 114, 116, 118, respectively. The relative stiffness or thickness of spring arms 16*c*, 18*c*, 20*c* and the degree of their respective curvatures are selected so that force of magnet 34 is always sufficient to smoothly rotate the cam lever 104 toward the wall bar 12 to establish electrical continuity between the face contacts 16, 18, 20 and the transfer contacts 16*a*, 18*a*, 20*a*, respectively. Socket module 100 is now in the activated configuration shown in to the side view of FIG. 17B. In the activated configuration electrical power is or can be supplied to plug 26.

When magnetic plug 26 is removed from socket 14, the magnetic force holding the cam lever 104 forward against the spring arms 16*c*, 18*c*, 20*c* is lessened or removed, thereby allowing the spring arms 16*c*, 18*c*, 20*c* to bend back to their original position which rotates the cam lever 104 about the pivot point 108 in the opposing direction and places the socket module 100 back into the inactivated configuration seen in FIG. 17A. Although it is not a preferred embodiment, plug 26 may be ferromagnetic instead of carrying magnet 34 and the attraction between the plug 26 and cam lever 104 will be provided by the interaction of the cam lever 104 with the ferromagnetic quality of plug 26.

Figure 18:
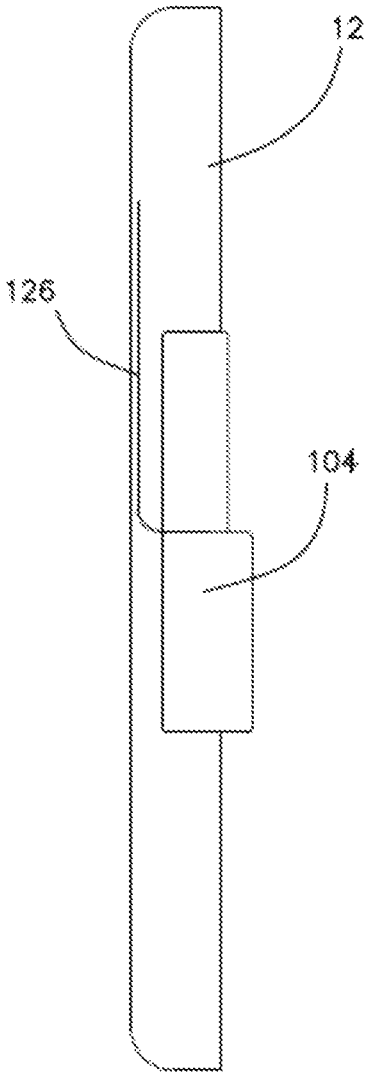
FIG. 18 is a top down cross sectional view of the alternative embodiment of the socket module comprising a plastic slide coupled to the cam lever.

Also included in the embodiment is a highly flexible, resilient plastic slide 126 that is coupled to the distal end of the cam lever 104 as seen in in the top down view of FIG. 18. The plastic slide 126 is specifically coupled to a lateral surface of the cam lever 104 such that the plastic slide 126 initially extends substantially parallel to the lateral surface of the cam lever 104. The plastic slide 126 is sufficiently flexible so that as the plastic slide 126 extends from the cam lever 104 and makes contact with the inner surface of the wall bar 12, the plastic slide 126 then bends so that the plastic slide 126 is orientated substantially perpendicular relative to the lateral surface of the cam lever 104 it is coupled to. The plastic slide 126 is shown in plan views in FIGS. 19A and 19B as including a plurality of holes 128 defined through its surface. The plastic slide 126 is further coupled to the cam lever 104 such that the plastic slide 126 is disposed at the same relative height as the face contacts 16, 18, 20 disposed within the sockets 14 of the wall bar 12.

Figure 19A:
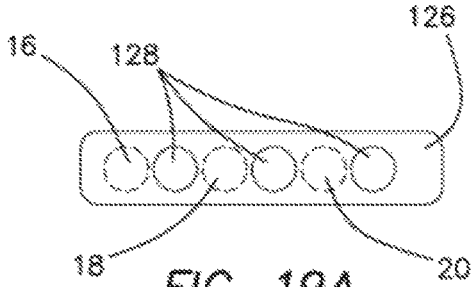
FIG. 19A is a frontal schematic view of the plastic slide covering the face contacts of the socket when the cam lever is in the inactive position.
Figure 19B:
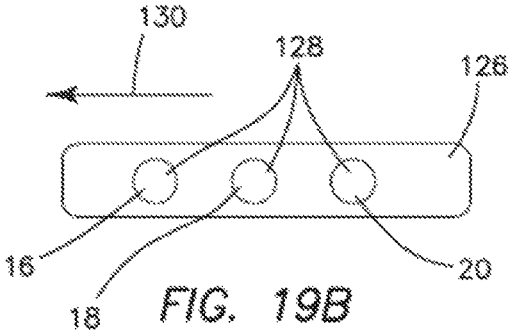
FIG. 19B is a frontal schematic view of the plastic slide exposing the face contacts of the socket when the cam lever is in the active position.

The plastic slide 126 cooperates with the operation of the cam lever 104 so as to expose the face contacts 16, 18, 20 only when a plug 26 is to be inserted into the socket module 100. Specifically, when the cam lever 104 is in the inactivated position seen in FIG. 17A, the plastic slide 126 covers the respective face contacts 16, 18, 20 as seen in FIG. 19A. As the cam lever 104 rotates forward toward the wall bar 12 as described above and seen in FIG. 17B, the plastic slide 126 moves in the direction denoted by arrow 130 which thereby moves each of the holes 128 over and aligns them with the face contacts 16, 18 and 20 disposed beneath so as to expose the face contacts 16, 18, 20 to the incoming plug 26. When the plug 26 is removed from the socket module 100, the cam lever 104 rotates away from the wall bar 12 which in turn retracts the plastic slide 126 back in the original direction and covers the face contacts 16, 18, 20 once again. The plastic slide 126 therefore ensures that the face contacts 16, 18, 20 are covered or otherwise protected from unwanted touching and possible electrocution when a plug 26 is not present.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contembard as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contembard that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contembard as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. An apparatus comprising:

a magnetically actuated electrical power socket; and a magnetic plug, wherein the magnetically actuated electrical power socket comprises:

an insulating fixed face;

a corresponding plurality of fixed conductive contacts in the face, the face contacts being normally without electrical power;

a rotatable cam lever coupled to an insulation layer adjacently disposed to the insulating fixed face;

a corresponding plurality of transfer contacts coupled to a distal end of a corresponding plurality of spring arms; and a screw terminal disposed on the insulation layer, wherein a proximal end of each of the plurality of spring arms are coupled to the screw terminal, the plurality of spring arms being disposed through the insulation layer, wherein the screw terminal is adapted to be coupled to a conventional three wire house wiring or conventional electrical power circuits.

2. The apparatus of claim 1 wherein the plurality of spring arms extend perpendicularly from a top surface of the insulation layer and are configured to make surface contact with a distal end of the cam lever.

3. The apparatus of claim 1 wherein the cam lever is configured to rotate about a pivot point whenever the magnetic plug is inserted or removed from the power socket.

4. The apparatus claim 1 wherein the cam lever further comprises a body coupled to the cam lever, wherein the body is comprised of insulating material.

5. The apparatus of claim 1 further comprising a flexible slide coupled to a lateral edge of the cam lever.

6. The apparatus of claim 5 wherein the flexible slide extends from the cam lever to an inner surface of the fixed face, a distal end of the flexible slide being orientated perpendicular relative the lateral edge of the cam lever and against the inner surface of the fixed face.

7. The apparatus of claim 5 wherein the flexible slide comprises a plurality of holes, wherein the plurality of holes are configured to expose the corresponding plurality of face contacts when the flexible slide is actuated.

8. The apparatus of claim 1 wherein where the magnetic plug comprises:

an insulating cylindrical plug body;

a plurality of conductive ring contacts provided on the face of the insulating cylindrical plug body; and a permanent magnet disposed in the center of the plug body around which the ring contacts are disposed.

9. A method of operating a magnetically actuated electrical power socket and magnetic plug comprising:

disposing the magnetic plug into a receiving socket well on a face of the power socket;

rotating a cam lever disposed behind the face of the power socket in a first direction against a spring force of a plurality of spring arms;

moving a plurality of transfer contacts disposed on the plurality of spring arms towards a corresponding plurality of face contacts disposed within the receiving socket well;

establishing electrical continuity between the plurality of transfer contacts and the plurality of face contacts; and rotating the cam lever in a second direction under the spring force from the plurality of spring arms.

10. The method of claim 9 wherein rotating the cam lever in an opposing direction under the spring force from the plurality of spring arms comprises removing the magnetic plug from the receiving socket well and relaxing the plurality of spring arms against the cam lever to push it in the second direction.

11. The method of claim 9 further comprising ceasing electrical continuity between the plurality of transfer contacts and the plurality of face contacts when the cam lever is rotated in the second direction.

12. The method of claim 9 further comprising:

exposing the plurality of face contacts disposed within the receiving socket well when the magnetic plug is disposed adjacent to the receiving socket well;

and covering the plurality of face contacts disposed within the receiving socket well when the magnetic plug is removed from the receiving socket well.

13. The method of claim 12 wherein exposing the plurality of face contacts disposed within the receiving socket well when the magnetic plug is disposed adjacent to the receiving socket well comprises:

sliding a flexible slide coupled to the cam lever in a direction which is perpendicular relative to the first direction of movement of the cam lever; and aligning a plurality of holes defined within the flexible slide with the face contacts.

14. The method of claim 12 wherein covering the plurality of face contacts disposed within the receiving socket well when the magnetic plug is removed from the receiving socket well comprises sliding a flexible slide coupled to the cam lever in a direction which is perpendicular relative to the second direction of movement of the cam lever.

15. The method of claim 9 wherein rotating the cam lever disposed behind the face of the power socket in a first direction against the spring force of the plurality of spring arms comprises rotating the cam lever under a magnetic interaction between the magnetic plug and the cam lever.

16. The method of claim 15 wherein moving the plurality of transfer contacts disposed on the plurality of spring arms towards the corresponding plurality of face contacts disposed within the receiving socket well comprises pushing the plurality of spring arms toward an inner surface of the face of the power socket with the cam lever.

17. The method of claim 9 wherein establishing electrical continuity between the plurality of transfer contacts and the plurality of face contacts further comprises establishing electrical continuity between the plurality of face contacts and a corresponding plurality of wires coupled to the plurality of spring arms.

18. The method of claim 17 further comprising electrically insulating the cam lever from the plurality of spring arms.

19. The method of claim 9 wherein rotating a cam lever disposed behind the face of the power socket in a first direction against a spring force of a plurality of spring arms comprises moving a flexible slide coupled to the cam lever in a perpendicular direction relative to the first direction of the cam lever.

20. The method of claim 9 wherein disposing the magnetic plug into a receiving socket well on a face of the power socket comprises aligning a plurality of conductive ring contacts provided on a face of the magnetic plug body.

* * * * *